US006326729B1

(12) United States Patent
Yokoo et al.

(10) Patent No.: US 6,326,729 B1
(45) Date of Patent: Dec. 4, 2001

(54) FIELD EMISSION CATHODE AND ELECTROMAGNETIC WAVE GENERATING APPARATUS COMPRISING THE SAME

(75) Inventors: Kuniyoshi Yokoo; Hidenori Mimura, both of Sendai (JP)

(73) Assignee: Tohoku University, Sendai (JP)

( * ) Notice: Subject to any disclaimer, the term of this patent is extended or adjusted under 35 U.S.C. 154(b) by 0 days.

(21) Appl. No.: 09/506,924

(22) Filed: Feb. 18, 2000

(30) Foreign Application Priority Data

Feb. 22, 1999 (JP) ..... 11-042845

(51) Int. Cl.[7] ..... H01J 25/00

(52) U.S. Cl. ..... 315/5; 315/3.5; 315/5.39; 315/169.1; 313/309; 313/351

(58) Field of Search ..... 315/5, 3.5, 5.7, 315/5.39, 5.37, 4, 169.1; 313/309, 351

(56) References Cited

U.S. PATENT DOCUMENTS

| | | | | |
|---|---|---|---|---|
| 4,955,086 | * | 9/1990 | Kindt | 455/605 |
| 5,359,256 | * | 10/1994 | Gray | 313/169 |
| 5,550,435 | * | 8/1996 | Kuriyama et al. | 315/169.1 |
| 5,680,011 | * | 10/1997 | Makishima | 315/3 |
| 5,866,979 | * | 2/1999 | Cathey, Jr. et al. | 313/496 |
| 5,986,388 | * | 11/1999 | Makishima | 313/309 |
| 6,040,973 | * | 3/2000 | Okamoto | 361/235 |

FOREIGN PATENT DOCUMENTS

| | | |
|---|---|---|
| 6255306 | 12/1984 | (JP) . |
| 5314892 | 11/1993 | (JP) . |
| 7107829 | 12/1994 | (JP) . |
| 8185794 | 7/1996 | (JP) . |

OTHER PUBLICATIONS

Japanese Office Action.

The Institute of Electronics, Information and Communication Engineers, Technical Report of IEICE, "THz wave free electron lasers using a photomixing field emission cathode", Kuniyoshi Yokoo, et al., pp. 7–12, 1998–12.

* cited by examiner

*Primary Examiner*—Hoanganh Le
*Assistant Examiner*—Tuyet T. Vo
(74) *Attorney, Agent, or Firm*—Stevens, Davis, Miller & Mosher, LLP

(57) ABSTRACT

In a field emission cathode emitting an electron beam modulated by any desired high frequency, a cathode tip is formed in one surface of an N type semiconductor substrate constituting a collector region, an insulating layer formed on the one surface of the semiconductor substrate to have an opening which surrounds said cathode tip, a gate electrode is formed on the insulating layer to have an opening which surrounds the cathode tip, a P type base region is formed in the other surface of the semiconductor substrate, a base electrode is formed on the base region, an N type emitter region is formed in the base region, and an emitter electrode is formed on the emitter region. A DC supply source is connected across the gate electrode and the emitter electrode and a high frequency supply source is connected across the base electrode and the emitter electrode. Then, an electron beam modulated by a high frequency within the millimeter wave or microwave region of the high frequency supply source can be emitted efficiently from said cathode tip. Additionally, an electron beam modulated at a high frequency is generated by applying the Gunn effect in a compound semiconductor to a field emission cathode. The thus generated electron beam is cooperated with a cavity resonator or Fabry-Pérot resonator, and an electromagnetic wave within the millimeter wave or microwave region can be efficiently generated.

26 Claims, 5 Drawing Sheets

FIELD EMISSION CATHODE AND ELECTROMAGNETIC WAVE GENERATING APPARATUS COMPRISING THE SAME

BACKGROUND OF THE INVENTION

1. Field of the Invention

The present invention relates to a cathode emitting electron, and more particularly relates to a field emission cathode emitting an electron beam which is modulated in accordance with a high frequency within the millimeter wave or microwave region. The present invention also relates to an electromagnetic wave generating apparatus comprising such a field emission cathode.

2. Explanation of the Related Art

Heretofore, electron beam devices, semiconductor devices and lasers have been used as a means for generating an electromagnetic wave.

As the electron beam device, there has been known a microwave electron tube such as magnetron and klystron. In this microwave electron tube, microwave energy is obtained by an interaction between an electron beam and a electric field of the microwave. Such microwave electron tube has been generally used for generating a relatively high power output and has a relatively high efficiency. However, when a wavelength of the electromagnetic wave to be generated becomes shorter, circuit structures composing the device are liable to be very small, the modulation of the electron beam might be very difficult, and a size of the device might become extremely large.

In the semiconductor device, an electromagnetic wave is generated by the modulation of electron travelling within the semiconductor material. However, since the. travelling velocity of electron within the semiconductor material is low, any useful electromagnetic wave generating apparatus of the order lower than millimeter wave region has not been developed.

Lasers generally generate light wave, but an infrared laser has been developed. As a far infrared laser, there has been developed a gas laser excited with light. Therefore, the apparatus is liable to be large in size and complicated in structure.

As explained above, any useful apparatus for generating a high power electromagnetic wave within the millimeter wave or microwave region with a high efficiency has not been developed.

SUMMARY OF THE INVENTION

The present invention has for its object to provide a novel and useful field emission cathode which can generate efficiently a high power electron beam modulated at any desired frequency within the millimeter wave or microwave region, while the structure of the field emission cathode can be simple and small.

Another object of the present invention is to provide an apparatus for generating efficiently a high power electromagnetic wave within the millimeter wave or microwave region by a cooperation of the electron beam emitted by the above mentioned field emission cathode, while the apparatus is small in size, simple in structure.

According to a first aspect of the present invention, a field emission cathode comprises:

- a collector region made of an N type semiconductor material;
- at least one cathode tip formed in a surface of said collector region;

- an insulating layer provided on the surface of said collector region and including at least one opening which surrounds said at least one cathode tip;
- a gate electrode provided on said insulating layer and including at least one opening which surrounds said at least one cathode tip;
- a base region made of a P type semiconductor material and being provided such that a pn junction is formed between said collector region and said base region; and
- at least one emitter region made of an N type semiconductor material and being provided such that a pn junction is formed between said base region and said at least one emitter region;
- wherein by connecting a high frequency supply source across the emitter region and the base region and by connecting a DC supply source across the gate electrode and the emitter region, an electron beam modulated in accordance with a high frequency of said high frequency supply source is emitted from said cathode tip.

In the field emission cathode according to the first aspect of the present invention, said collector region, base region and emitter region may be formed by a semiconductor substrate such as silicon (Si), germanium (Ge), gallium arsenide (GaAs) and indium phosphide (InP). In the field emission cathode according to the first aspect of the invention, the cathode tip is formed on one surface of the semi-conductor substrate and the base and emitter regions are formed in the other surface of the semiconductor substrate. Therefore, the cathode tip structure can be precisely and easily formed and at the same time the base and emitter regions can be also formed precisely and easily.

In a preferable embodiment of the field emission cathode according to the first aspect of the invention, a plurality of arrays each including a plurality of linearly aligned cathode tips are formed in one surface of said semiconductor substrate, and a corresponding plurality of arrays each including a plurality of linearly aligned emitter regions are formed in the other surface of the semiconductor substrate. In this embodiment, emitter electrode and base electrode may be advantageously formed in an interdigital manner. Further, it is preferable to form the cathode tip to have a sharp front end. Then, an efficiency of the generation of the electron beam can be improved due to a concentration of the electric field at the sharp front end of the cathode tip.

According to a second aspect of the invention, a field emission cathode comprises:

- an emitter region made of an N type semiconductor material having the Gunn effect;
- at least one cathode tip formed in a surface of said emitter region;
- an insulating layer including at least one opening which surrounds said at least one cathode tip;
- a gate electrode provided on said insulating layer and including at least one opening which surrounds said at least one cathode tip; and
- an emitter electrode electrically connected to said emitter region;
- wherein a high electric field domain is produced periodically with a high frequency within said emitter region by applying a DC supply voltage across the gate electrode and the emitter electrode, and an electron beam modulated in accordance with said high frequency is emitted from said cathode tip.

As is well known, the Gunn effect pertains to high-frequency oscillation of electrical current flowing through n-type bulk semiconductors such a gallium arsenide (GaAs), indium phosphide (InP) and Cadmium Tellurium (CdTe). It was discovered by J. B. Gunn in 1963 (J. B. Gunn, Solid State Communications, Vol. 1, p. 88 (1963)). The effect is used in solid state devices, e.g., Gunn diodes, to produce short radio waves called microwaves. The Encyclopaedia Britannica defines the Gunn effect as follows:

"In material displaying the Gunn effect electrons can exist in two states of mobility, or ease of movement. Electrons in the state of higher mobility move through the solid more easily than electrons than electrons in the lower mobility state. When no electrical voltage is applied to the material, most of its electrons are in the high mobility state. When an electrical voltage is applied, all its electrons begin to move just as in ordinary conductors. This motion constitutes an electrical current, and in most solids greater voltages cause increased movement of all the electrons and hence greater current flow. In Gunn-effect materials, however, a sufficiently strong electrical voltage may force some of the electrons into the state of lower mobility, causing them to move more slowly and decreasing the electrical conductivity of the material. In electronic circuits incorporating the Gunn diode, this unusual relationship between voltage and current (motion) results in the generation of high-frequency alternating current from a direct-current source." Definition of Gunn effect, (Feb. 13, 2001) <http:// www.britannic.com>

In the field emission cathode according to the above mentioned second aspect of the invention, the emitter region including the cathode tip may be made of N type compound semiconductor material having the Gunn effect such as GaAs and InP.

In the field emission cathode according to the first aspect of the present invention, the modulation frequency of the emitted electron beam is determined by the frequency of the high frequency supply source connected across the emitter region and the base region, but in the field emission cathode according to the second aspect of the invention, the modulation frequency of the electron beam is determined by structure and size of the emitter region including the cathode tip, a voltage applied to the emitter region, and so on.

In a preferable embodiment of the field emission cathode according to the second aspect of the invention, said emitter electrode is formed on the surface of the emitter region which is opposite to the surface in which said at least one cathode tip is formed. In this embodiment, a high electric field domain preventing region made of an intrinsic or P type semiconductor material may be formed to surround said emitter region, and said insulating layer is formed on said high electric field domain preventing region Furthermore, said emitter region and high electric field domain preventing region may have a coplanar surface and said emitter electrode may be formed on said coplanar surface of said emitter region and high electric field domain preventing region.

In another embodiment of the field emission cathode according to the second aspect of the invention, said emitter electrode is formed on the same surface of the emitter region in which said at least one cathode tip is formed and said emitter electrode is electrically connected to said emitter region through a via hole formed in the insulating layer. In this embodiment, a high electric field domain preventing region made of an intrinsic or P type semiconductor material may be formed on the surface of said emitter region which is opposite to the surface in which said at least one cathode tip is formed. Furthermore, an ohmic region made of a highly doped N type semiconductor material may be formed to surround said emitter region, said insulating layer may be formed on said ohmic region, and said emitter electrode may be connected to said ohmic region. In this structure, it is preferable that said emitter region and ohmic region have a coplanar surface and said high electric field domain preventing region is formed on said coplanar surface.

Also in the field emission cathode according to the second aspect of the present invention, a plurality of arrays each including a plurality of linearly aligned cathode tips may be advantageously formed in one surface of said semiconductor substrate.

According to the third aspect of the present invention, an electromagnetic wave generating apparatus comprises:

the field emission cathode according to the first or second aspect of the invention; and an electromagnetic wave generating means for cooperating with the electron beam modulated in accordance with a high frequency and emitted from said field emission cathode to generate an electromagnetic wave.

In a preferable embodiment of the electromagnetic wave generating apparatus according to the third aspect of the invention, said electron beam emitted from said field emission cathode is modulated by a frequency within the millimeter wave or microwave region, and said electromagnetic wave generating means includes a high frequency circuit which cooperates with the electron beam modulated by a frequency within the millimeter wave or microwave region. In this case, said high frequency circuit may include a cavity resonator which cooperates with the modulated electron beam to generate the electromagnetic wave and an output circuit for guiding the thus generated electromagnetic wave to external or may include a slow wave circuit such as helix which cooperates with the modulated electron beam to generate the electromagnetic wave and an output circuit for guiding the thus generated electromagnetic wave to external.

In another preferable embodiment of the electromagnetic wave generating apparatus according to the third aspect of the invention, said electromagnetic wave generating means comprises a Fabry-Pérot resonator having a periodic structure such as a metal grating and a reflecting plate which are arranged to be opposed to each other with respect to a pass of the modulated electron beam emitted from said field emission cathode such that a field of cooperation between the modulated electron beam and an electromagnetic wave is formed. In such an apparatus, said reflecting plate may have an opening through which the electromagnetic wave is emitted.

In the electromagnetic wave generating apparatus according to the third aspect of the invention, it is preferable to provide a collector electrode which collects the electron beam passed through said high frequency circuit or said Fabry-Pérot resonator. By applying a bias voltage lower than a potential on the cavity resonator or periodic structure to said collector electrode, a part of the kinetic energy of the electron beam can be restored and an efficiency of the electromagnetic wave generating apparatus can be improved.

EXPLANATION OF PREFERRED EMBODIMENTS

Hereafter, the present invention will be explained in detail with reference to the accompanying drawings.

Figure 1:
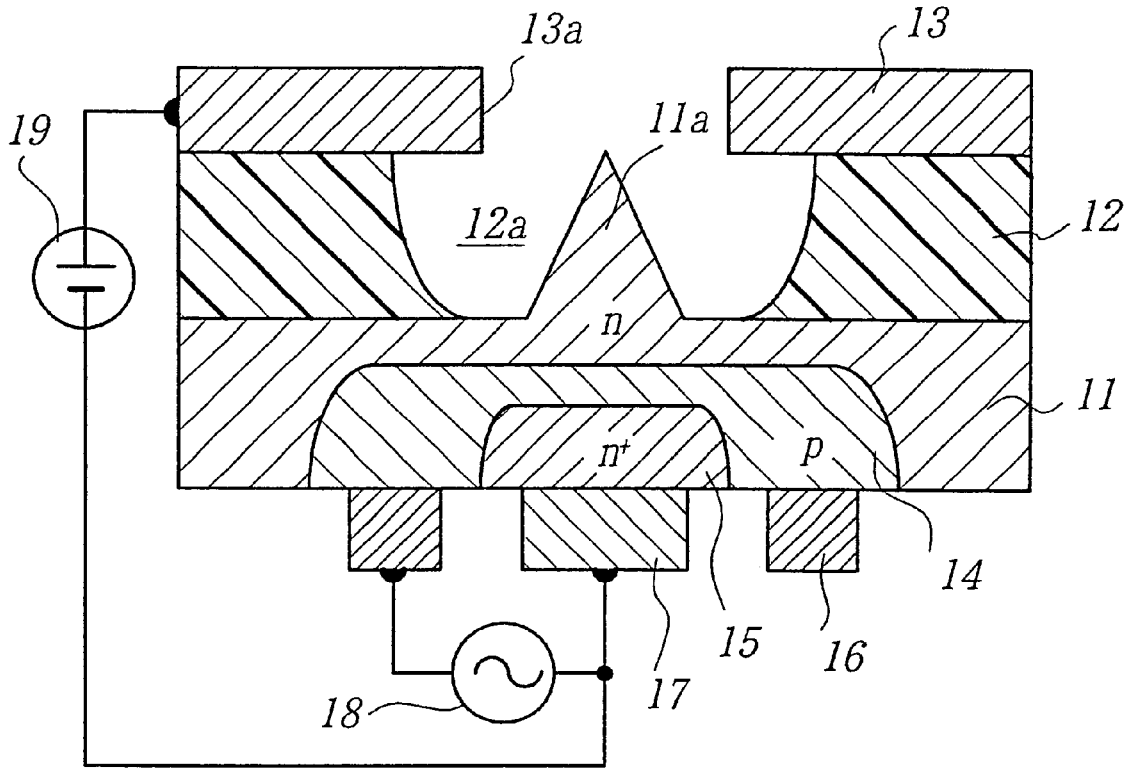
FIG. 1 is a cross sectional view showing an embodiment of the field emission cathode according to the first aspect of the invention.
Figure 2:
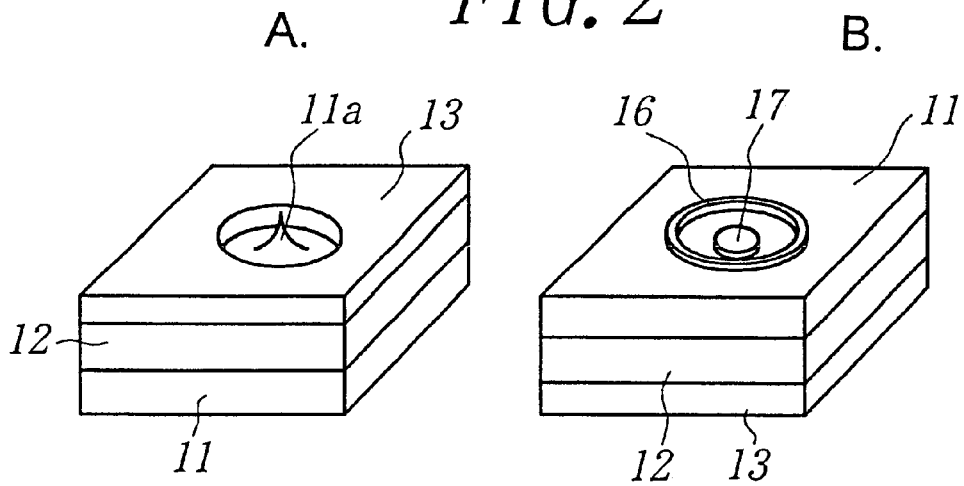
FIGS. 2A and 2B are perspective views illustrating front and rear surfaces of a semiconductor substrate of the filed emission cathode shown in FIG. 1.

FIG. 1 is a cross sectional view showing a first embodiment of the field emission cathode according to the first aspect of the present invention, and FIGS. 2A and 2B are perspective views illustrating front and rear surfaces of a semiconductor substrate of the field emission cathode. In the present embodiment, a cathode tip 11*a* is formed in a front surface of a semiconductor substrate 11 which constitutes a collector region of a transistor. The semiconductor substrate 11 may be made of any suitable semiconductor material. In the present embodiment, the substrate 11 is made of N type silicon. The cathode tip 11*a* has a very sharp front end just like as a needle, and thus the electric field is liable to be concentrated at the front end of the cathode tip 11*a* . On the front surface of the silicon substrate 11, there is provided an insulating layer 12 having an opening 12*a* which surrounds the cathode tip 11*a*. The insulating layer 12 may be made of silicon oxide. On the insulating layer 12, there is further provided a gate electrode 13 having an opening 13*a* which also surrounds the cathode tip 11*a*. The gate electrode 13 may be made of a metal such as tantrum.

In a rear surface of the silicon substrate 11 which constitutes the collector region, there is formed a P type base region 14 and an $N^+$ type emitter region 15 is formed within the base region 14. On the base region 14 there is formed a base electrode 16 and on the emitter region 15, there is formed an emitter electrode 17. These base and emitter electrodes 16 and 17 may be made of a metal such as aluminum.

In the above explained field emission cathode according to the first aspect of the invention, the cathode tip 11*a* is formed in one surface of the semiconductor substrate 11, said one surface being opposite to the other surface in which the base region 14 and emitter region 15 of the transistor are formed. It should be noted that it has been proposed to form the field emission cathode tip together with the transistor. For instance, in the Fourth International Vacuum Microelectronics Conference Report, Ting et al, 1991, U.S. Pat. No. 5,359,256 and Japanese Patent Laid-open Publication Kokai Hei 5-314892, known field emission cathodes having such a structure have been described. However, in these known field emission cathodes, the cathode tip is formed in the surface of the semiconductor substrate in which also the base region and emitter region are formed. From the view point of manufacturing, it is very difficult to form the field emission cathode tip in the same surface of the semiconductor substrate in which the base and emitter regions of a high frequency transistor arc also formed. Due to this difficulty, the known field emission cathodes have not been practically developed. According to the first aspect of the invention, since the cathode tip 11*a* is formed in the front surface of the semiconductor substrate 11 and the base and emitter regions of the high frequency transistor arc formed in the rear surface of the semiconductor substrate, and therefore the high frequency transistor as well as the cathode tip 11*a* can be manufactured precisely and easily without being affected by the mutual interference.

As depicted in FIG. 1, in the field emission cathode according to the first aspect of the present invention, a high frequency supply source 18 is connected across the base electrode 16 and the emitter electrode 17, said high frequency supply source having a high frequency within the millimeter wave or microwave region. A D.C. supply source 19 is connected across the emitter electrode 17 and the gate electrode 13 such that the gate electrode has a positive polarity. Then, an electron beam modulated in accordance with the high frequency of said high frequency supply source 18 is emitted from the field emission cathode tip 11*a* through the opening 13*a* formed in the gate electrode 13.

Figure 3:
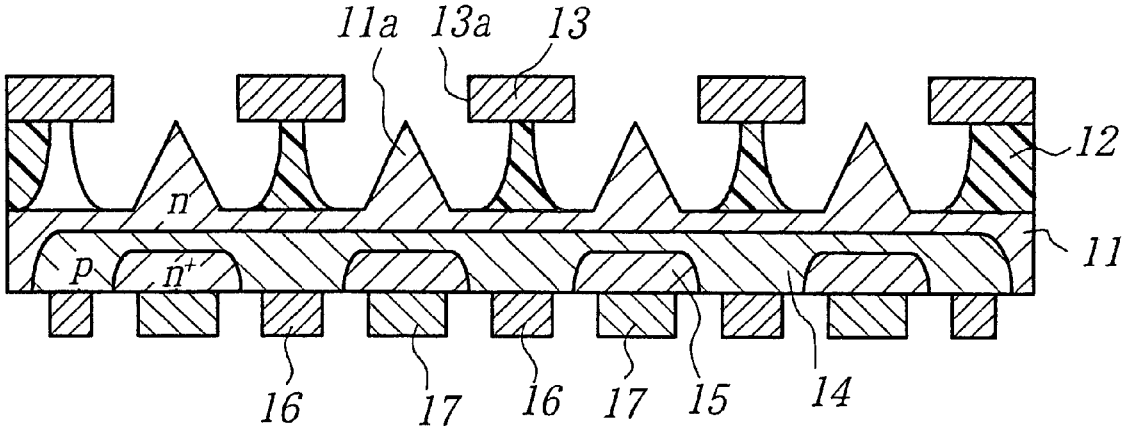
FIG. 3 is a cross sectional view depicting another embodiment of the field emission cathode according to the first aspect of the invention.
Figure 4:
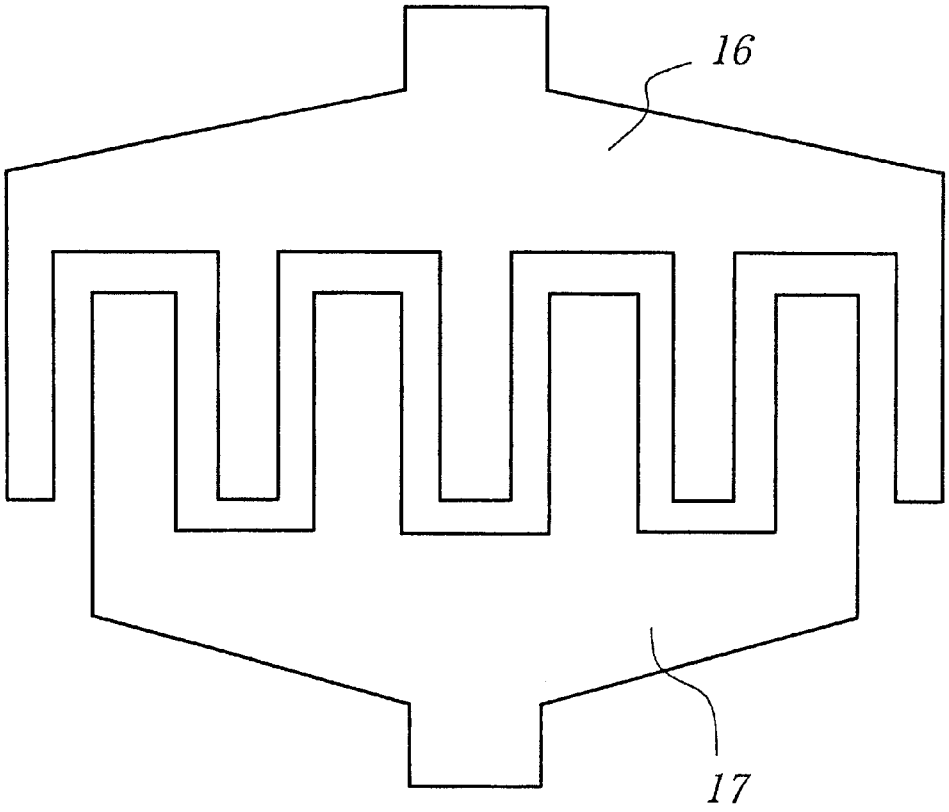
FIG. 4 is a plan view showing a rear surface of the semiconductor substrate of the field emission cathode of FIG. 3.

FIG. 3 is a cross sectional view showing a modified embodiment of the field emission cathode according to the first aspect of the invention, and FIG. 4 is a plan view showing an electrode structure provided on a rear surface of a semiconductor substrate. In the present embodiment, in a front surface of an N type semiconductor substrate 11 constituting the collector region of the high frequency transistor, there are formed a plurality of arrays each including a plurality of cathode tips 11*a* linearly aligned in a direction perpendicular to a plane of the drawing of FIG. 3. A gate electrode 13 having a plurality of openings 13*a* corresponding to respective cathode tips 11*a* is provided on the front surface of the semiconductor substrate 11 via an insulating layer 12. In a rear surface of the semiconductor substrate 11, there is formed a common P type base region 14 and a plurality of N type emitter regions 15 are formed within the base region 14 such that the emitter regions 15 are corresponding to respective arrays of the cathode tips 11*a*. Therefore, base electrode 16 and emitter electrode 17 are formed in the interdigital fashion as illustrated in FIG. 4.

Figure 5:
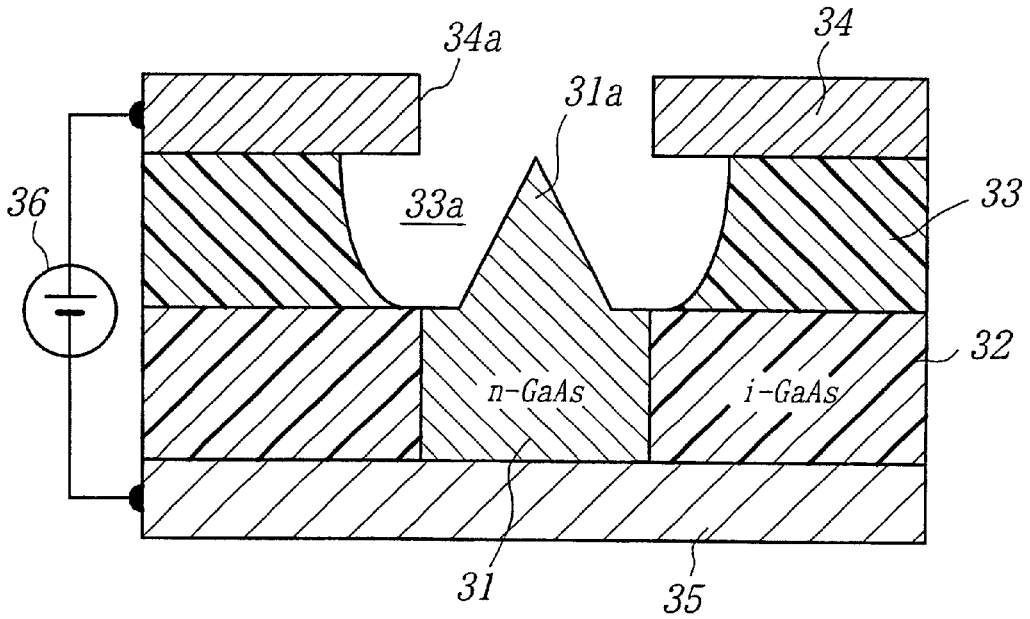
FIG. 5 is a cross sectional view showing an embodiment of the field emission cathode according to the second aspect of the invention.

FIG. 5 is a cross sectional view showing an embodiment of the field emission cathode according to the second aspect of the invention. In this field emission cathode, an emitter 31 having a cathode tip 31*a* from which an electron beam is emitted is made of N type semiconductor material having the Gunn effect. In the present embodiment, the emitter 31 is made of GaAs, but according to the invention, it may be made of other semiconductor material having the Gunn effect such as InP. Also in the present embodiment, the cathode tip 31*a* has a needle-like front end.

A high electric field domain preventing region 32 is formed to surround the emitter region 31. The high electric field domain preventing region 32 is made of intrinsic or P type semiconductor material. In the present embodiment, the high electric field domain preventing region 32 is made of intrinsic gallium arsenate (i-GaAs). On the high electric field domain preventing region 32 there is formed an insulating layer 33 having an opening 33*a* which surrounds the cathode tip 31*a,* and on the insulating layer 33 there is formed a gate electrode 34 having an opening 34*a* which also surrounds the cathode tip 31*a*. Rear surfaces of the emitter region 31 and high electric field domain preventing region 32 are formed to be coplanar, and an emitter electrode 35 is formed on this coplanar surface. The gate electrode 34 and emitter electrode 35 may be made on a metal having a highly ohmic property such as gold and germanium.

When a DC supply source 36 is connected between the gate electrode 34 and the emitter electrode 35 and a high voltage is applied across these electrodes, a high electric field domain such as space charge accumulating domain and electric double layer domain is produced within the emitter region 31 made of N type semiconductor material due to space charges. These space charges travel in the semiconductor body of the emitter region 31 and are then emitted from the cathode tip 31*a*. In this case, the production, travelling and emission of space charges are repeated periodically, and therefore the electron beam emitted also periodically. A period of such a periodic production of the high electric field domain is determined mainly by the structure of the N type semiconductor emitter 31 having the Gunn effect and a value of the high DC voltage applied across the gate electrode 34 and the emitter electrode 35. Then, the period can be easily set to the millimeter wave or microwave region. In this manner, the electron beam modulated in accordance with a high frequency within the millimeter wave or microwave region can be emitted from the cathode tip 31*a* through the opening 34*a* formed in the gate electrode 34. The high electric field domain preventing region 32 surrounding the emitter region 31 and being made of the intrinsic or P type semiconductor material serves to restrict the generation of the high electric filed domain only to the N type semiconductor material constituting the emitter region 31.

Figure 6:
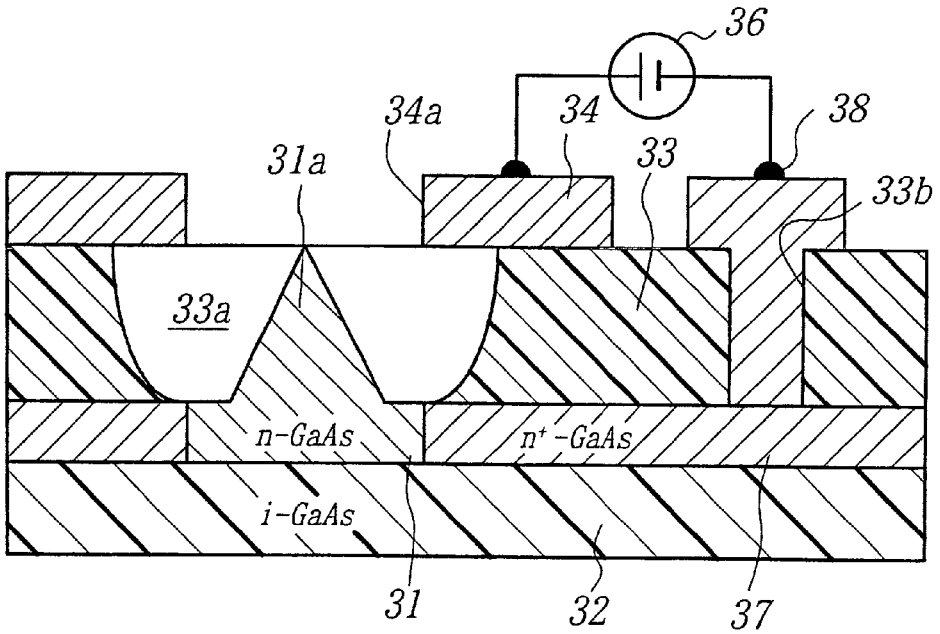
FIG. 6 is a cross sectional view showing another embodiment of the field emission cathode according to the second aspect of the invention.

FIG. 6 is a cross sectional view showing another embodiment of the field emission cathode according to the second aspect of the invention. In the present embodiment, an emitter region 31 having a cathode tip 31*a* formed thereon and an ohmic region 37 made of N+ type semiconductor material having a large amount of impurities doped therewith are provided on a high electric field preventing region 32 made of an intrinsic semiconductor material. The ohmic region 37 formed an ohmic junction between the emitter region 31.

An emitter electrode 38 is formed on an insulating layer 33 provided on the ohmic region 37. The emitter electrode 38 extends to the upper surface of the ohmic region 37 through a via hole 33*b* formed in the insulating layer 33. In the present embodiment, the gate electrode 34 and emitter electrode 38 are formed on the same side of the insulating layer 33, and the so-called flat structure is obtained. Also in the present embodiment, a DC supply source 36 is connected between the gate electrode 34 and the emitter electrode 38 such that the emitter is positive relative to the base. Then, an electron beam Modulated in accordance with a high frequency is emitted from the cathode tip 31*a* through the opening 34*a* formed in the gate electrode 34.

In the above explained field emission cathode according to the first and second aspects of the invention, various portions have fine structures of a size from one micron meter to sub-micron meters. Such a fine structures can be precisely manufactured by the film forming technique, patterning technique and etching technique well developed in the semiconductor device manufacturing field.

Figure 7:
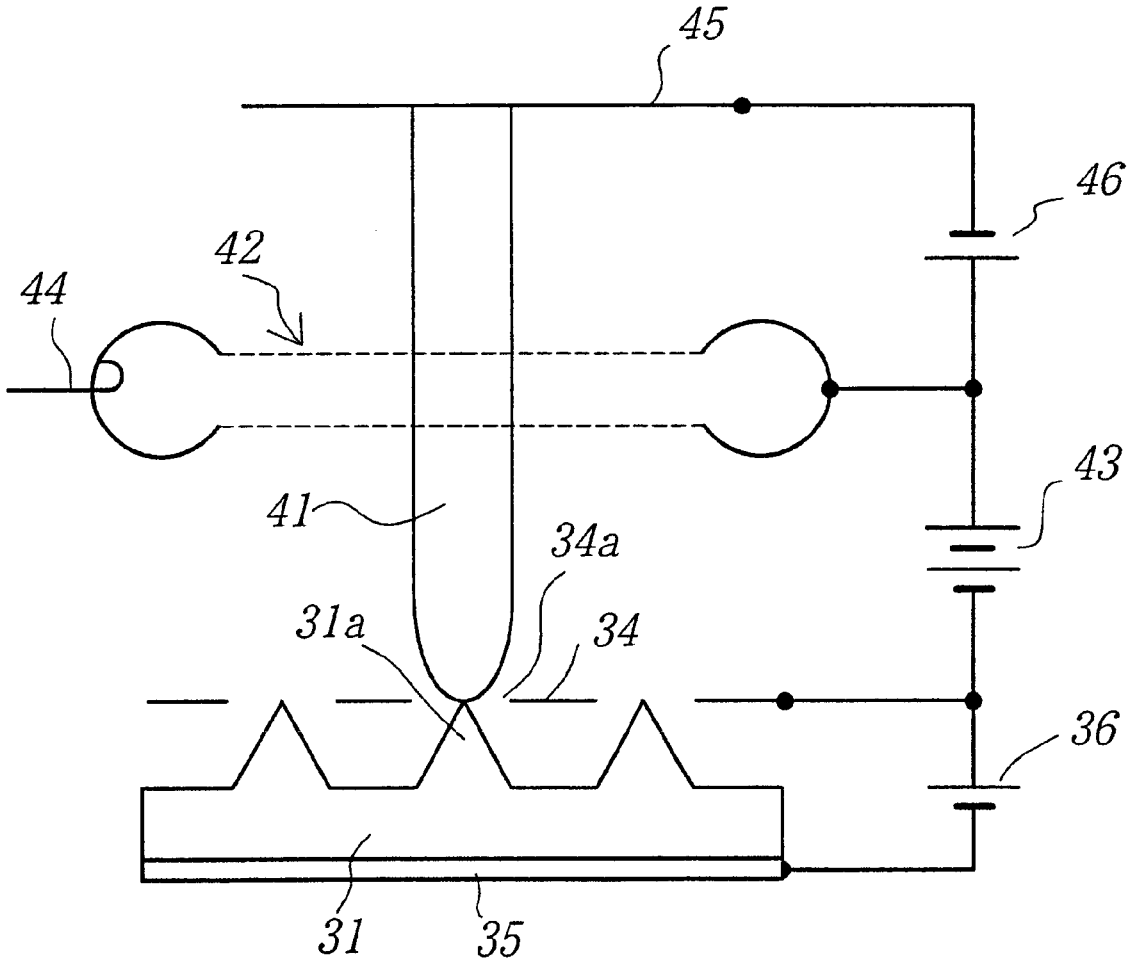
FIG. 7 is a diagrammatic cross sectional view illustrating a first embodiment of the electromagnetic wave generating apparatus according to the third aspect of the invention.

FIG. 7 is a schematic view showing an embodiment of the electromagnetic wave generating apparatus according to the third aspect of the invention. In the present embodiment, the electromagnetic wave generating apparatus comprises the field emission cathode shown in FIG. 5 according to the second aspect of the invention. It should be noted that the field emission cathode includes a plurality of arrays each including a plurality of linearly aligned cathode tips 31*a* as illustrated in FIG. 7. The DC supply source 36 is connected between the gate electrode 34 and the emitter electrode 35, and an electron beam 41 modulated in accordance with a high frequency within the millimeter wave or microwave region is emitted from the cathode tips 31*a* through the openings 34*a* formed in the gate electrode 34. This DC supply source 36 contributes to the field emission of the electron beam and thus may be called a field emission DC supply source.

The modulated electron beam 41 thus emitted from the cathode tip 31*a* of the field emission cathode is accelerated by an accelerating DC supply source 43 connected between the gate electrode 34 and a cavity resonator 42 which is arranged to be faced with the gate electrode. The thus accelerated electron beam 41 is cooperated with an electromagnetic wave within the cavity resonator 42 and the kinetic energy of the electron beam is converted into the electromagnetic wave energy. The thus generated electromagnetic wave within the millimeter wave or microwave region is derived to the external via an output circuit 44. After cooperation with the cavity resonator 42, the electron beam 41 is collected by a collector electrode 45. Since a DC voltage lower than a potential on the cavity resonator 42 is applied to the collector electrode 45, a part of the kinetic energy of the electron beam can be restored.

Figure 8:
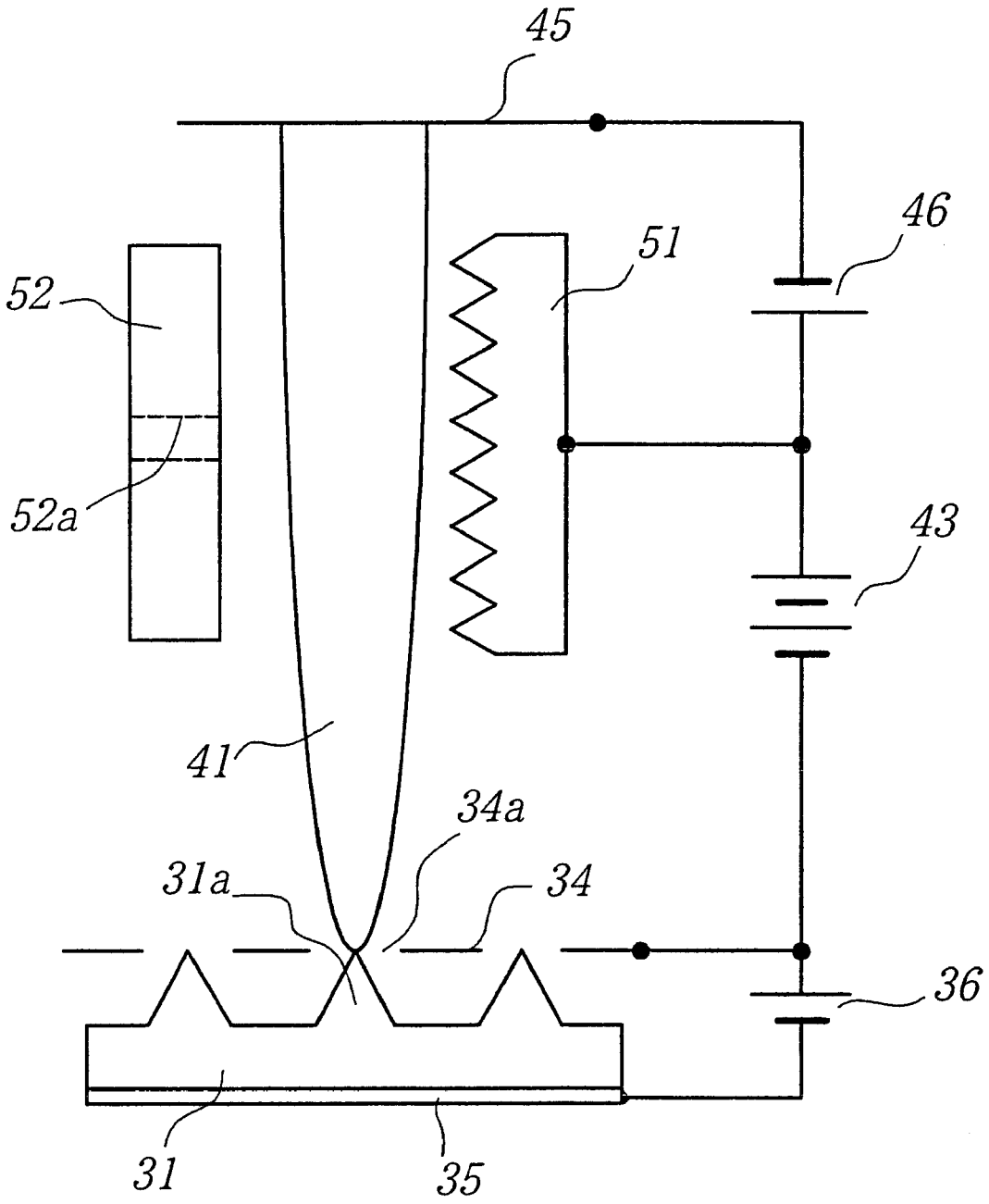
FIG. 8 is a diagrammatic cross sectional view illustrating a second embodiment of the electromagnetic wave generating apparatus according to the third aspect of the invention.

FIG. 8 is a schematic view depicting another embodiment of the electromagnetic wave generating apparatus according to the third aspect of the invention. Also in the present embodiment, the field emission cathode including a plurality of arrays each including a plurality of linearly aligned cathode tips 31*a* as illustrated in FIG. 5 is utilized.

In this embodiment, an electron beam 41 modulated in accordance with a high frequency within the millimeter wave or microwave region and emitted from the cathode tips 31*a* of the field emission cathode is accelerated by an accelerating DC supply source 43 and is guided to a Fabry-Pérot resonator consisting of a periodic structure 51 formed by a metal grating and a reflection plate 52. The electron beam 41 emitted from the field emission cathode is cooperated with the electromagnetic wave produced within the Fabry-Pérot resonator to produce a high power electromagnetic wave modulated by the high frequency within the millimeter wave or microwave region. The thus generated electromagnetic wave is guided to the outside through a bole 52*a* formed in the reflection plate 52. After cooperating with the electromagnetic wave within the resonator, the electron beam 41 is collected by a collection electrode 45. As explained above, when a potential lower than the periodic structure 51 is applied to the collector electrode 45 by a third DC supply source 46, a part of the kinetic energy of the electron beam after the cooperation can be restored, and an efficiency of the generation of electromagnetic wave can be increased.

In the present embodiment, the frequency of the generated electromagnetic wave may be adjusted over a wide range by controlling a travelling speed of the electron along the periodic structure 51 by suitably adjusting the voltage of the accelerating DC supply source 43 or by adjusting a distance between the periodic structure 51 and the reflection plate 52 of the Fabry-Pérot resonator.

The present invention is not limited to the embodiments explained above, but many alternations and modifications may be conceived by a person who is skilled in the art within the scope of the invention. For instance, in the above embodiments, the electromagnetic wave generating apparatus includes the field emission cathode shown in FIG. 5, but the field emission cathodes depicted in FIGS. 1–4 may be used to construct the electromagnetic wave generating apparatus. Moreover, in the above embodiments of the electromagnetic wave generating apparatus, the high frequency circuit is formed by the cavity resonator and Fabury Peror resonator, but according to the invention, the high frequency circuit may be formed by a slow wave circuit such as a helix or dielectric loading circuit or magnetic wiggler.

Furthermore, the cathode tip of the field emission cathode according to the invention may be formed in the collector of the high speed operation transistor such as high speed bipolar transistor (HBT), high electron mobility transistor (HEMT) or short channel field effect transistor (FET). The field emission cathode according to the invention may be applied not only to the above explained electromagnetic wave generating apparatus, but also to a conventional microwave tube such as klystron and travelling wave tube, which are based on the bunching effect of the electron beam which interacts with an electromagnetic wave. Moreover, the field emission cathode emitting the electron beam modulated in accordance with a high frequency within the millimeter wave or microwave region may be utilized as cathode of a linear accelerator. Then, a free electron laser having a high efficiency and a small size could be realized.

In the field emission cathode according to the invention, by constructing the cathode tip from which the electron beam is to be emitted is formed by the collector region or N type semiconductor material having the gun effect and operating at the millimeter wave region or microwave region, it is possible to emit the modulated electron beam efficiently. Furthermore, the field emission cathode according to the invention has a simple structure and can be manufactured precisely and easily by utilizing the well developed semiconductor device manufacturing process.

In the electromagnetic wave generating apparatus according to the invention, the high power electromagnetic wave can be generated efficiently by the cooperation of the modulated electron beam emitted from the above mentioned field emission cathode with the electromagnetic field generated within the high frequency circuit such as the Fabry-Pérot resonator, cavity resonator, helix and magnetic wiggler and the frequency of the generated electromagnetic wave can be controlled over a wide frequency range from the millimeter wave region to the microwave region.

What is claimed is:

1. A field emission cathode comprising:

a collector region made of an N type semiconductor material;

at least one cathode tip formed in a surface of said collector region;

an insulating layer provided on the surface of said collector region and including at least one opening which surrounds said at least one cathode tip;

a gate electrode provided on said insulating layer and including at least one opening which surrounds said at least one cathode tip;

a base region made of a P type semiconductor material and being provided such that a pn junction is formed between said collector region and said base region; and at least one emitter region made of an N type semiconductor material and being provided such that a pn junction is formed between said base region and said at least one emitter region;

wherein by connecting a high frequency supply source across the emitter region and the base region and by connecting a DC supply source across the gate electrode and the emitter region, an electron beam modulated in accordance with a high frequency of said high frequency supply source is emitted from said cathode tip.

2. A field emission cathode as claimed in claim 1, wherein said collector region, base region and emitter region are formed by a semiconductor substrate.

3. A field emission cathode as claimed in claim 2, wherein a plurality of arrays each including a plurality of linearly aligned cathode tips are formed in one surface of said semiconductor substrate, and a corresponding plurality of arrays each including a plurality of linearly aligned emitter regions are formed in the other surface of the semiconductor substrate.

4. A field emission cathode as claimed in claim 3, wherein said cathode tip is formed to have a sharp front end.

5. A field emission cathode comprising:

an emitter region made of an N type compound semiconductor material having the Gunn effect:

at least one cathode tip formed in a surface of said emitted region;

an insulating layer including at least one opening which surrounds said at least one cathode tip;

a gate electrode provided on said insulating layer and including at least one opening which surrounds said at least one cathode tip; and and emitter electrode electrically connected to said emitter region;

wherein a high electric field domain is produced periodically with a high frequency within said emitter region by applying a DC supply voltage across the gate electrode and the emitter electrode, and an electron beam modulated in accordance with said high frequency is emitted from said cathode tip.

6. A field emission cathode as claimed in claim 5, wherein said cathode tip is formed to have a sharp front end.

7. A field emission cathode as claimed in claim 6, wherein said emitter electrode is formed on the surface of the emitter region which is opposite to the surface in which said at least one cathode tip is formed.

8. A field emission cathode as claimed in claim 7, wherein a high electric field domain preventing region made of an intrinsic or P type semiconductor material is formed to surround said emitter region, and said insulating layer is formed on said high electric field domain preventing region.

9. A field emission cathode as claimed in claim 8, wherein said emitter region and high electric field domain preventing region have a coplanar surface and said emitter electrode is formed on said coplanar surface of said emitter region and high electric field domain preventing region.

10. A field emission cathode as claimed in claim 9, wherein said emitter electrode is formed on the same surface of the emitter region in which said at least one cathode tip is formed and said emitter electrode is electrically connected to said emitter region through a via hole formed in the insulating layer.

11. A field emission cathode as claimed in claim 10, wherein a high electric field domain preventing region made of an intrinsic or P type semiconductor material is formed on the surface of said emitter region which is opposite to the surface in which said at least one cathode tip is formed.

12. A field emission cathode as claimed in claim 11, wherein an ohmic region made of a highly doped N type semiconductor material is formed to surround said emitter region, said insulating layer is formed on said ohmic region, and said emitter electrode is connected to said ohmic region.

13. A field emission cathode as claimed in claim 12, wherein said emitter region and ohmic region have a coplanar surface, and said high electric field domain preventing region is formed on said coplanar surface.

14. A field emission cathode as claimed in claim 6, wherein a plurality of arrays each including a plurality of linearly aligned cathode tips are formed in one surface of said emitter region.

15. An electromagnetic wave generating apparatus comprising the field emission cathode as claimed in any one of claims 1, and an electromagnetic wave generating means for cooperating with the electron beam modulated in accordance with a high frequency and emitted from said field emission cathode to generate an electromagnetic wave.

16. An apparatus as claimed in claim 15, wherein said electron beam emitted from said field emission cathode is modulated by a frequency within the millimeter wave or microwave region, and said electromagnetic wave generating means includes a high frequency circuit which cooperates with the electron beam modulated by a frequency within the millimeter wave or microwave region.

17. An apparatus an claimed in claim 16, wherein said high frequency circuit includes a slow wave circuit which cooperates with the modulated electron beam to generate the electromagnetic wave and an output circuit for guiding the thus generated electromagnetic wave to external.

18. An apparatus as claimed in claim 7, wherein said slow wave circuit is formed by a helix.

19. An apparatus as claimed in claim 16, wherein said high frequency circuit includes a cavity resonator which cooperates with the modulated electron beam to generate the electromagnetic wave and an output circuit for guiding the thus generated electromagnetic wave to external.

20. An apparatus as claimed in claim 19, wherein a collector electrode is provided to collect a part of the electron beam passed through the cavity resonator.

21. An apparatus as claimed in claim 20, wherein a bias voltage lower than a potential on the periodic structure is applied to said collector electrode.

22. An apparatus as clawed in claim 15, wherein said electro-magnetic wave generating means comprises a Fabry-Pérot resonator having a periodic structure and a reflecting plate which are arranged to be opposed to each other with respect to a pass of the modulated electron beam emitted from said field emission cathode such that a field of cooperation between the modulated electron beam and an electromagnetic field is formed.

23. An apparatus as claimed in claim 22, wherein said periodic structure is formed by a metal grating.

24. An apparatus as claimed in claim 22, wherein said reflecting plate has an opening through which the electromagnetic wave is emitted.

25. An apparatus as claimed in claim 22, wherein a collector electrode is provided to collect a part of the electron beam passed through the Fabry-Pérot resonator.

26. An apparatus as claimed in claim 25, wherein to said collector electrode is applied a bias voltage which is lower than a potential on the periodic structure.

* * * * *